United States Patent [19]

Forney, Jr. et al.

[11] 4,360,244

[45] Nov. 23, 1982

[54] MINIATURE COAXIAL CONNECTOR ASSEMBLY

[75] Inventors: Edgar W. Forney, Jr., Harrisburg; Richard S. Hogendobler, Camp Hill, both of Pa.

[73] Assignee: AMP Incorporated, Harrisburg, Pa.

[21] Appl. No.: 149,073

[22] Filed: May 12, 1980

[51] Int. Cl.[3] ..... H01R 17/04

[52] U.S. Cl. ..... 339/177 R

[58] Field of Search ..... 339/177 R, 177 E, 258 R, 339/17 C

[56] References Cited

U.S. PATENT DOCUMENTS

| | | | |
|---|---|---|---|
| 1,332,241 | 3/1920 | Waters | 339/258 R |
| 2,335,041 | 11/1943 | Bruno | 339/177 R |
| 2,952,823 | 9/1960 | Robinson | 333/97 |
| 3,047,828 | 7/1962 | Gregson et al. | 339/177 R X |
| 3,160,456 | 12/1964 | O'Keefe et al. | 339/92 |
| 3,179,912 | 4/1965 | Huber et al. | 339/17 |
| 3,302,159 | 1/1967 | Schumacher | 339/177 R |
| 3,383,457 | 5/1968 | Schumacher et al. | 174/68.5 |
| 3,663,901 | 5/1972 | Forney | 333/97 R |
| 3,915,535 | 10/1975 | O'Keefe et al. | 339/17 C |
| 4,165,911 | 8/1979 | Laudig | 339/177 E X |
| 4,186,981 | 2/1980 | Holton | 339/258 R X |

FOREIGN PATENT DOCUMENTS

| | | | |
|---|---|---|---|
| 1157274 | 5/1958 | France | 339/177 E |

OTHER PUBLICATIONS

H. H. Buggie Catalog, Apr. 1958, H.H.B. No. 4229.

*Primary Examiner*—Joseph H. McGlynn
*Attorney, Agent, or Firm*—Adrian J. LaRue

[57] ABSTRACT

A miniature right angle coaxial cable connector is disclosed for cable to printed circuit board interconnection, and comprises mateable cable terminating and printed circuit board mounted units. The cable terminating unit consists of two tubular bodies joined at right angles, having respective mateable contact members seated therein; with one of the contacts terminating the center conductor of the coaxial cable. The printed circuit board mounted unit mates with the cable terminating unit, and consists of a unitary right angle profiled tubular shell open along an outer side for accommodating the receipt of a right angled pin therein. A second elongate pin contact is vertically inserted into an outer wall of the right angle shell body, and remote ends of the straight and right angled pin contacts project downwardly in parallel from the tubular shell for insertion through a printed circuit board.

6 Claims, 5 Drawing Figures

MINIATURE COAXIAL CONNECTOR ASSEMBLY

BACKGROUND OF THE INVENTION

1. The Field of the Invention

The present invention relates to a miniature right angle coaxial cable connector for interconnecting a coaxial cable to a printed circuit board. More specifically, the present invention relates to a connector for such an application comprising a pair of mateable connector units, one of which is terminating the coaxial cable, and the other establishing electrical contact with printed circuit board circuitry.

2. The Prior Art

In many commercial applications, as well as many test applications, it is desirable to feed a coaxial RF signal line through to printed circuit board circuitry. Because of the stringent performance requirements, and the relatively limited space constraints, a suitable coaxial connector for coaxial cable to printed circuit board circuitry interconnection has been difficult to achieve, for such a connector must be miniature in scale, yet must meet adequate performance requirements, at least to a frequency of 2 GHZ.

Heretofore, most coaxial cable connectors for miniature applications were of a multi-piece design, with assembly of component parts of the connector being somewhat cumbersome. Typically, available connectors comprise two right angle mating units, with one unit being intended for printed circuit board mount, and the other for the termination of a coaxial cable. Since each mating connector unit must be of an overall right angle profile, the difficulty has been in loading similarly profiled contact members into respective mating unit shells having the aforesaid right angle profile. No convenient way heretofore has been achieved for convenient loading of contact members into miniature right angle connector shells.

The industry has therefore been in need of a miniature right angle coaxial cable connector for interconnecting a coaxial cable to printed circuit board circuitry. Such a connector must be inexpensive to produce, of a general miniature scale, and must meet substantial RF performance requirements. Moreover, assembly of such a connector must be readily achievable, minimizing intricate or elaborate assembly techniques or time intensive multiple soldering operations.

SUMMARY OF THE PRESENT INVENTION

The present invention contemplates a right angle coaxial cable connector for interconnecting coaxial cable conductors with printed circuit board circuitry. The connector constitutes mateable right angle cable terminating and printed circuit board mounted units. The cable terminating unit consists of two tubular bodies having ends joined at right angles and having respective contact members therein adapted to solderlessly mate. One of the contact members, which terminates the center conductor of a coaxial cable, is adapted to project through the opposite tubular body to engage the contact member seated therein. The printed circuit board mounted unit is characterized by a unitary right angle profiled tubular shell open along an outer side for receiving a similarly profiled right angle pin therein. An elongate straight contact pin is inserted into an outer wall of the right angle profile tubular shell, and remote ends of the straight pin and the right angle pin contacts are adapted to project downwardly in parallel from the tubular shell for insertion through a printed circuit board.

Accordingly, it is an object of the present invention to provide a miniature right angle coaxial cable connector for printed circuit board circuitry to coaxial cable interconnection.

Still further, it is an object of the present invention to provide a miniature right angle coaxial cable connector which is readily assembled.

Still further, it is an object of the present invention to provide a right angle coaxial cable connector characterized having a pair of mating connector units, one of which having a unitary outer shell, and the other having a bi-component shell configuration.

Yet a further object of the present invention is to provide a high RF performance right angle coaxial cable connector for coaxial cable to printed circuit board interconnection.

A further object of the present invention is to provide a miniature right angle coaxial cable connector which is economically and readily produced.

These and other objects which will become apparent to one skilled in the art are achieved by a preferred embodiment which is described in detail below, and which is illustrated in the accompanying drawings.

BRIEF DESCRIPTION OF THE ACCOMPANYING DRAWINGS

FIG. 1 is a longitudinal section view through mated coaxial cable connector units structured according to the present invention.

FIG. 1-A is a perspective view of the spring end of one contact member illustrated in FIG. 1, intended to matingly receive the forward end of a second contact member therein.

FIGS. 2-A, 2-B, and 2-C, are sequential transverse section views of the printed circuit board interconnecting connector unit of FIG. 1, illustrating the assembly of said connector unit pursuant to the teachings of the present invention.

DETAILED DESCRIPTION OF THE PREFERRED EMBODIMENT

Figures 1, 1A:
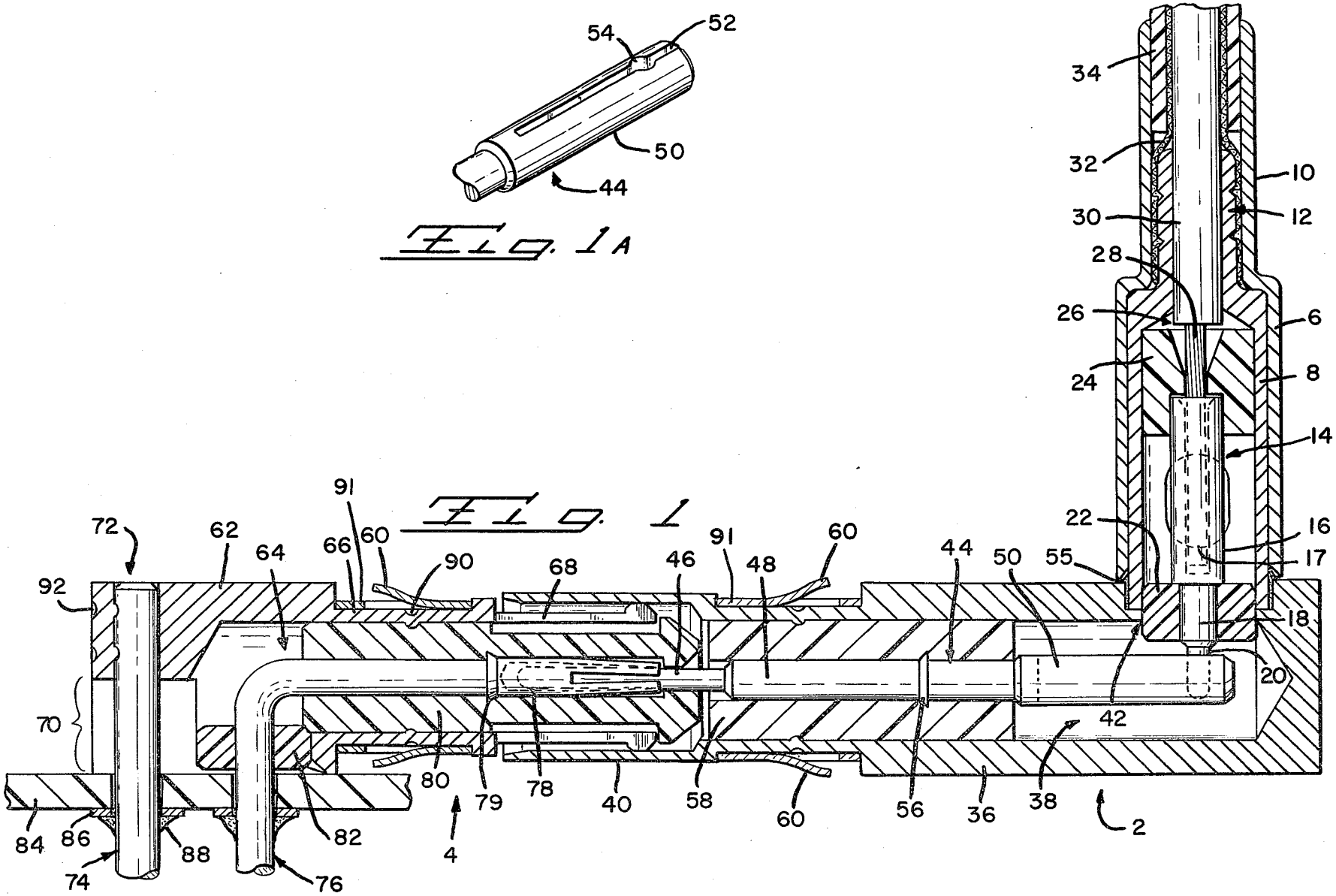

Referring to FIG. 1, the subject invention is embodied by a cable terminating connector unit 2 and a printed circuit board circuitry connecting unit 4. The cable terminating unit 2 comprises a tubular outer shell body 6 and a tubular inner shell body 8, each having a respective smaller diametered rearward sleeve portion 10, 12, respectively. Seated within the inner shell body 8 is a stepped profile contact member 14, comprising a rearward cylindrical crimp sleeve 16, which is exteriorly accessible by means of a crimping porthole 17, a pin intermediate section 18, and a forward male pin portion 20. The sections 16, 18, and 20, of the contact member 14 are contiguously joined by corresponding steps provided along the profile of the contact member. A forward dielectric insert 22 is circumferentially positioned about the intermediate portion 18 of the contact member 14, and effectively serves to insulate the contact member from the inner shell body 8. A second rearwardly disposed dielectric insert 24, is likewise provided to circumferentiate and insulate the contact member 14 from the rearward portion of the shell body 8.

As shown by FIG. 1, a coaxial cable 26, of the type intended to be terminated, constitutes a central conductor 28 having an outer dielectric casing 30 therearound, and an outer conductive shield 32 surrounded by an exterior dielectric sheath 34. It will be appreciated that the center conductor 28 is inserted into the crimping sleeve 16 of the contact member 14, and the crimping sleeve 16 thereafter crimped upon the center conductor by appropriate tooling which is operational through the crimping porthole 17 (not shown). The outer conductive shield 32 of the cable is situated over the rearward sleeve 12 of the inner conductive body 8, and the outer tubular shell 6 is brought thereover and circumferentially crimped to establish mechanical and electrical contact between the cable shield and the inner conductor body 8, as well as to close off the crimping porthole 17. A high performance RF cable end termination is thereby effectuated.

The horizontal component of the cable terminating unit 2 is characterized by a tubular shell body 36 having an internal passageway 38 extending therein from a forward mating profiled end 40. The shell body 36 is further provided with a counter opening 42 in one longitudinal side thereof. A second contact member 44 is seated within the internal passageway 38, and includes a forward pin portion 46, an intermediate pin segment 48, and a rearward cylindrical spring portion 50. The rearward cylindrical spring portion 50, as shown by FIG. 1-A, is structured having a longitudinal slot 52 formed therein from a rearward end, and a receptacle bore 54 extending transversely therethrough. The receptacle bore 54 is bisected by the longitudinal slot 52, and is dimensioned to matingly receive the forward pin segment 20 of the contact member 14. So structured, the cylindrical spring portion 50 serves to maintain resilient contact force against the pin segment 20, and a good electrical and mechanical connection is thereby preserved over time. It will be apparent that the opening 42 is step profiled to accommodate limited receipt of a forward end of the inner shell body 8 therein, such that the forward pin segment 20, and intermediate pin segment 18 project through the opening 42 and into passageway 38. Thereupon, the pin segment mates with the pin portion 50, and the forward end of the shell body 8 is soldered to the shell body 36 as indicated at numeral 55 of FIG. 1.

Continuing, with reference to FIG. 1, the intermediate pin segment 48 is provided with an annular flange 56 extending outwardly therefrom, and a dielectric insert 58 is provided within the passageway 38 to receive and electrically insulate the pin member from the sidewalls of the shell body 36. The annular flange 56 of the pin engages the dielectric insert 58 and prevents withdrawl of the pin therefrom. Further provided on the outer shell body 36, is a napkin type spring 91 with two or more outwardly directed, retention tines 60 which function to retain the tubular outer shell body 36 within a connector housing block cavity (not shown).

The mating half of the subject connector, unit 4, is shown to comprise a tubular right angle profiled body 62 having a through passageway 64 therein. The right angle profiled body 62 includes an intermediate horizontal segment 66, and a forward horizontal segment 68 which is profiled to be matingly received into the forward mating profiled end 40 of the opposite unit shell body 36. An access opening 70 is provided along a vertical outside wall of the tubular shell body 62, for a purpose to be described in greater detail below. An additional pin receiving vertical cavity 72 is provided within an outer sidewall of the tubular shell body 62, and is generally rearwardly located therein.

A straight profiled pin contact 74, and a right angle profiled pin contact 76 are structured for assembly into the shell body 62. The right angle pin contact 76 comprises a forward female receptacle end 78 adapted for mating engagement with the forward pin contact portion 46 of the contact member 44. An annular flange 79 is likewise provided to project outwardly from the right angle pin contact 76, and is retained within a dielectric insert 80. The dielectric insert 80 serves to electrically isolate the right angle pin contact from the shell body. An additional dielectric insert 82 surrounds the right angle pin contact 76 proximate the opposite end thereof, and closes off the bottom of the unit, as well as additionally insulating the contact 76.

Remote ends of the straight profiled pin contact 74 and the right angle profiled pin contact 76 are intended to be inserted through a printed circuit board 84, and establish electrical contact with electrical circuitry 86 by means of solder joints 88. It will be appreciated that an electrical path is thereby established from the center conductor 28 of the coaxial cable 26, through the pin contacts 14, 44, and 76, and to the circuit board circuitry 86. The straight profiled pin contact 74 is inserted into the pin receiving cavity 72 of the shell body 62, and electrical contact is established therebetween. Thus, the outer conductive shield 32 of the coaxial cable 26 is electrically connected to the printed circuit board circuitry 86 along a path through the interconductive body 12, the shell bodies 36 and 62 and the straight profiled pin 74.

Figure 2A:
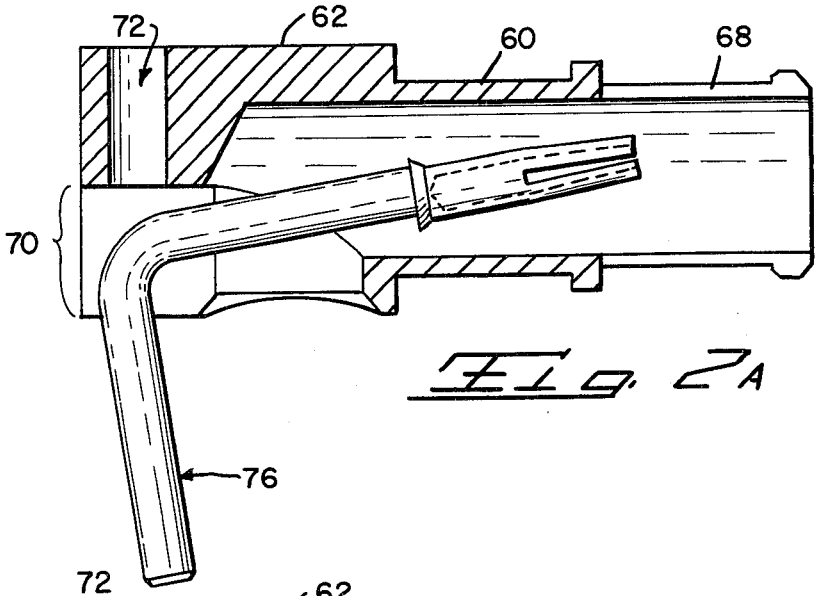
Figure 2B:
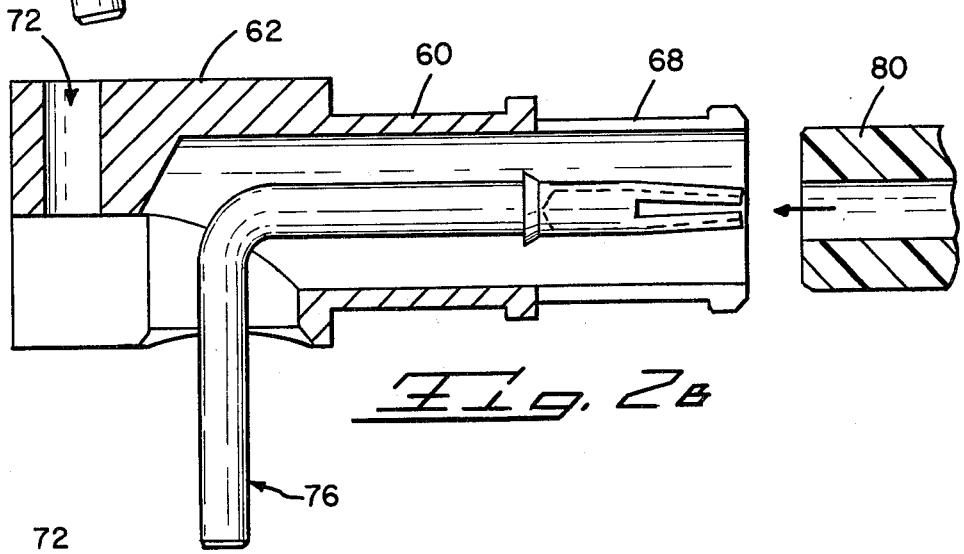
Figure 2C:
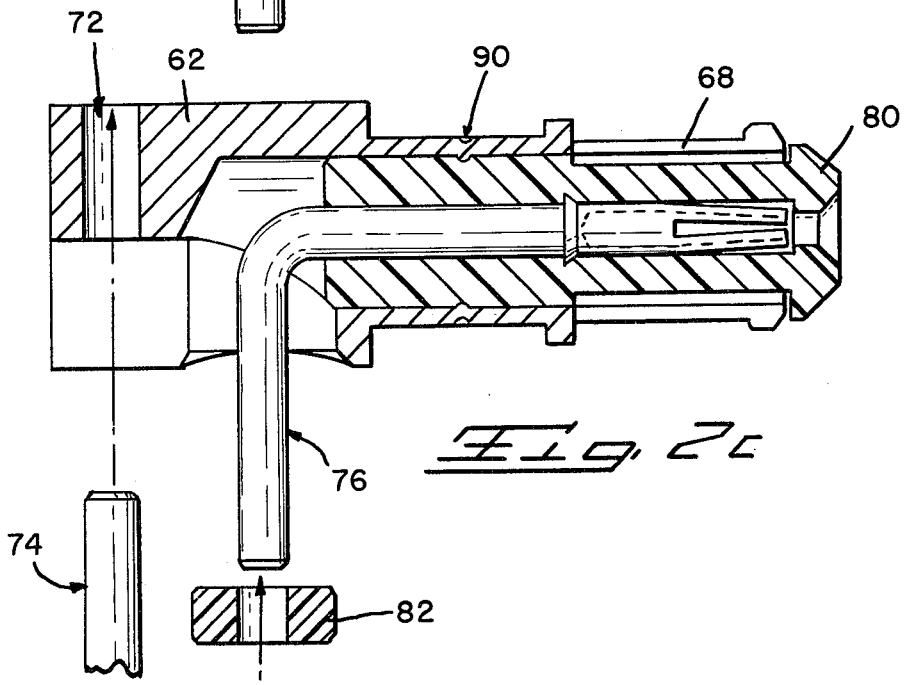

Assembly of the printed circuit board interconnecting unit 4 is illustrated in sequence by FIGS. 2-A, 2-B, and 2-C, and proceeds as follows. The right angle profiled pin contact 76 is moved into the passageway 64 of the shell body 62 by way of the access opening 70. The access opening 70 is sufficiently large to permit the maneuvering of the right angle profiled pin 76 into an appropriate position within the shell body 62. Thereafter, as shown by FIG. 2-B, the dielectric insert 80 is inserted into the passageway 64, surrounding the pin 76 located therein. By a staking of the sides of the shell body 62, as indicated at numeral 90 of FIG. 2-C, the dielectric insert 80 is securely retained within the shell body. Subsequently, the straight profiled pin contact 74 is inserted into the pin receiving cavity 72 of the shell body, and by a similar staking of the side of the shell body (indicated at numeral 92 of FIG. 1), the pin contact 74 is securely retained within the outer shell body 62, and there located functions to generally close off the access opening 70 of the shell body. The second dielectric insert 82 is then inserted over the remote end of the right angle profiled pin 76 and into the right angle profiled shell body 62 as indicated in FIG. 2-C. The entire unit 4, thus assembled, can be mounted onto the printed circuit board as shown by FIG. 1.

It should be noted that the subject connector units 2, and 4, incorporate a relatively few number of component parts. The relatively few number of connector components provides substantial cost savings in the production of the subject invention. Moreover, assembly of the subject connector is substantially simplified, with the only soldering being required in the assembly of the subject connector is that needed to electrically and mechanically join the outer conductive shell body 8, to the horizontal shell body 36, as shown at numeral 55 of FIG. 1. Moreover, the solder joint 55 is a factory operation on the right angle cable part. From the users standpoint, he will receive two components- the body assembly and the ferrule outer body for crimping the cable shield. Installation of the two components to the cable is essentially a two crimp operation. Further, the printed circuit board assembly is of one piece construction, and is installed into the board by soldering.

While the foregoing describes the preferred embodiment of the subject invention, the principles of the subject invention are not to be so confined. Other embodiments, which will be apparent to one skilled in the art, and which utilize the teachings herein set forth, are intended to be within the scope and spirit of the present invention.

What is claimed is:

1. A right angle coaxial cable connector comprising:

first tubular conductive body means having a profiled passageway extending lengthwise therein from a forward end to a rearward end and an opening extending through said first tubular conductive body means proximate said rearward end and communicating with said passageway;

dielectric means in said passageway;

a first electrical contact means disposed in said dielectric means isolating said first contact means from said tubular conductive body means and having forward contact means and rear contact means in alignment with said opening;

second tubular conductive body means secured on said first tubular conductive body means around said opening and having a crimping section onto which outer conductor means of coaxial cable means is to be crimpably secured;

dielectric member means in said second tubular conductive body means; and second electrical contact means disposed in said dielectric member means isolating said second electrical contact means from said second tubular conductive body means and having inner contact means in electrical engagement with said rear contact means and outer contact means for electrical connection with the center conductor of the coaxial connector means.

2. A right angle coaxial cable connector as set forth in claim 1 wherein said inner contact means comprises a pin member; and said rear contact means comprises a longitudinal slot extending therein from an end thereof defining spring contact means and opposing recesses in surfaces of said longitudinal slot receiving said pin member therein.

3. A right angle coaxial cable connector as set forth in claim 1 wherein said second tubular conductive body means includes crimping porthole means therein for crimping said inner contact means to the center conductor.

4. A right angle coaxial cable connector for printed circuit to coaxial cable interconnect, comprising:

a. a coaxial cable terminating unit comprising:

a first tubular conductive body having a profiled passageway extending lengthwise therein from a forward end, and a counter bore extending through a side of said tubular body proximate a rearward end thereof and communicating with said passageway;

a first elongate contact member seated within said first body passageway in electrical isolation from said first body, and having forward profiled mating end means and rearward profiled mating end means;

a second elongate conductive tubular body having a forward end perpendicularly connected to said first tubular body and encompassing said counter bore and having a rearward end adapted for connection with a coaxial cable outer conductor;

a second elongate contact member seated within said second body in electrical isolation therefrom, and having forward profiled end means for extending through said counter bore and matingly engaging said rearward profiled end means of said first contact member, and said second contact member having a rearward end adapted for connection to a coaxial cable center conductor;

b. a printed circuit engaging unit comprising:

third and fourth contact members each having a depending end adapted for insertion into a printed circuit board, said third contact member having an elongate profile, and said fourth contact member comprising a right angle profiled pin having a forward end adapted to mate with said forward profiled end means of said first contact member;

a right angle profiled third tubular conductive body comprising horizontal and vertical shell portions, said vertical shell portion having an opening extending along substantially an outer vertical side thereof where through said third body receives said fourth contact member into said body generally intermediate thereof with said depending end of said fourth contact member projecting downwardly from said vertical shell portion;

said vertical shell portion having a receptacle cavity extending upwardly into said outer side of said vertical shell portion, said cavity receiving an opposite end of said third contact member therein with said depending third contact member end projecting downward in parallel with said depending fourth contact member end.

5. A right angle coaxial cable connector for connection to conductive means of a printed circuit board, comprising:

a right angle tubular conductive body means having vertical and horizontal openings in communication, said vertical opening extending from a bottom of said tubular conductive body means to a position about midway of an outer vertical side thereof, said tubular conductive body means having a contact-receiving opening in axial alignment with said vertical opening;

dielectric means secured in said horizontal opening;

first electrical contact means having an inner contact section and an outer contact section at right angles with respect to said inner contact section, said inner contact section disposed in said dielectric means isolating said first electrical contact means from said tubular conductive body means, said outer contact section extending through said vertical opening beyond said bottom for electrical connection with conductive means of the printed circuit board; and second electrical contact means having a first section electrically secured in said contact-receiving opening and a second section extending parallel with respect to said outer contact section and along and through said vertical opening beyond said bottom for electrical connection with other conductive means of the printed circuit board.

6. A right angle coaxial cable connector as set forth in claim 5 wherein further dielectric means is disposed in said vertical opening in which said outer contact section is disposed.

* * * * *